US005392588A

United States Patent [19]

Morrison

[11] Patent Number: 5,392,588

[45] Date of Patent: Feb. 28, 1995

[54] SPINNING WITH HOLLOW ROTATABLE SHAFT AND AIR FLOW

[75] Inventor: Elbert F. Morrison, Clarksville, Va.

[73] Assignee: Burlington Industries, Inc., Greensboro, N.C.

[21] Appl. No.: 996,865

[22] Filed: Dec. 15, 1992

Related U.S. Application Data

[63] Continuation of Ser. No. 263,187, Oct. 27, 1988, abandoned, which is a continuation of Ser. No. 41,835, Apr. 21, 1987, Pat. No. 4,928,464, which is a continuation of Ser. No. 680,510, Dec. 11, 1984, Pat. No. 4,719,744, which is a continuation-in-part of Ser. No. 386,078, Jun. 7, 1982, Pat. No. 4,507,913.

[51] Int. Cl.[6] ..... D01H 5/28; D01H 1/12; D02G 1/00

[52] U.S. Cl. ..... 57/328; 57/5; 57/224; 57/333; 57/341; 57/350; 57/351

[58] Field of Search ..... 57/5, 6, 224, 328, 333, 57/341, 342, 343, 350, 351

[56] References Cited

U.S. PATENT DOCUMENTS

| | | | |
|---|---|---|---|
| Re. 31,705 | 10/1984 | Morihashi | 57/224 |
| 2,020,960 | 11/1935 | Pehrson et al. | 34/20 |
| 2,239,722 | 4/1941 | Lannan et al. | 57/343 X |
| 2,809,024 | 10/1957 | Simon et al. | 34/137 |
| 3,079,746 | 3/1963 | Field | 57/328 |
| 3,332,227 | 7/1967 | Marshall | 57/2 |
| 3,365,872 | 1/1968 | Field | 57/328 |
| 3,367,095 | 2/1968 | Field | 57/5 |
| 3,495,393 | 2/1970 | Wada et al. | 57/12 |
| 3,568,428 | 3/1971 | Stentiford et al. | 57/227 |
| 3,596,458 | 8/1971 | Nakano et al. | 57/2 |
| 3,596,459 | 8/1971 | Wada et al. | 57/12 X |
| 3,621,646 | 11/1971 | Bobkowicz et al. | 57/224 |
| 3,691,750 | 9/1972 | Waters | 57/207 X |
| 3,707,838 | 1/1973 | Dorschner et al. | 19/0.46 |
| 3,757,507 | 9/1973 | Maxham | 57/409 X |
| 3,802,174 | 4/1974 | Landwehrkamp et al. | 57/5 |
| 3,822,543 | 7/1974 | Edagawa et al. | 57/328 |
| 3,845,611 | 11/1974 | Senturk et al. | 57/5 |
| 3,877,211 | 4/1975 | Saveliev et al. | 57/404 |
| 3,913,310 | 10/1975 | Fehrer | 57/401 |
| 3,978,648 | 9/1976 | Yamagata et al. | 57/5 |
| 3,996,731 | 12/1976 | Koella | 19/105 X |
| 4,003,194 | 1/1977 | Yamagata et al. | 57/328 |
| 4,070,812 | 1/1978 | Ostrowski et al. | 57/403 |
| 4,073,128 | 2/1978 | Ostrowski et al. | 57/403 |

(List continued on next page.)

FOREIGN PATENT DOCUMENTS

| | | |
|---|---|---|
| 499131 | 4/1979 | Australia . |
| 3303686 | 8/1983 | Germany . |
| 3303686A1 | 8/1993 | Germany . |
| 1-70872 | of 1989 | Japan . |
| 1-118627 | of 1989 | Japan . |
| 1-118628 | of 1989 | Japan . |
| 1-118629 | of 1989 | Japan . |
| 1-118630 | of 1989 | Japan . |
| 1-132835 | of 1989 | Japan . |

*Primary Examiner*—Daniel P. Stodola
*Assistant Examiner*—William Stryjewski
*Attorney, Agent, or Firm*—Nixon & Vanderhye

[57] ABSTRACT

A method for spinning yarn produce the yarn having properties generally comparable to those of ring spun yarn. A rotatable hollow shaft having an entrance at one end and an exit at the other is rotatable about an axis extending in a direction A. A number of free fibers are fed in the linear direction A in a fiber mass, certain of the fibers having free trailing ends. The fiber mass is passed into the interior of the hollow rotatable shaft through the entrance. An air flow is established with respect to the shaft to effect separation of the free trailing ends of the fibers, preferably by establishing an air flow path that is initially substantially unidirectionally in direction A and then is deflected to move at an angle with respect to the direction A away from the shaft. The shaft is rotated at high speed about its axis so that the trailing ends of the fibers wrap around other portions of the fiber mass to produce a yarn, and the yarn is withdrawn through the exit of the shaft. The air flow may be provided by a vacuum which acts on the free fibers, and which may comprise the only source of force being applied to the fibers.

12 Claims, 5 Drawing Sheets

U.S. PATENT DOCUMENTS

| | | | |
|---|---|---|---|
| 4,073,129 | 2/1978 | Ostrowski et al. | 57/403 |
| 4,109,454 | 8/1978 | Fehrer et al. | 57/401 |
| 4,183,202 | 1/1980 | Morihashi | 57/328 |
| 4,207,728 | 6/1980 | Ostrowski et al. | 57/403 |
| 4,249,368 | 2/1981 | Fehrer | 57/5 |
| 4,265,082 | 5/1981 | Sasaki et al. | 57/328 X |
| 4,322,944 | 4/1982 | Sraitr et al. | 57/328 |
| 4,450,675 | 5/1984 | Petrov et al. | 57/6 |
| 4,450,676 | 5/1984 | Sakamoto et al. | 57/6 |
| 4,484,436 | 11/1984 | Nakayama et al. | 57/328 |
| 4,492,075 | 1/1985 | Faure | 57/224 X |
| 4,495,757 | 1/1985 | Dimitrov | 57/5 |
| 4,507,913 | 4/1985 | Morrison | 57/328 |
| 4,509,321 | 4/1985 | Kajita et al. | 57/328 |
| 4,509,322 | 4/1985 | Briner et al. | 57/328 X |
| 4,598,537 | 7/1986 | Kroupa et al. | 57/328 X |
| 4,631,912 | 12/1986 | Hardy | 57/328 X |
| 4,635,435 | 1/1987 | Morrison et al. | 57/328 |
| 4,693,071 | 9/1987 | Morrison | 57/328 X |
| 4,713,931 | 12/1987 | Morrison et al. | 57/328 |
| 4,719,744 | 1/1988 | Morrison | 57/5 |
| 4,827,710 | 5/1989 | Nishimura | 57/328 |
| 4,845,932 | 7/1989 | Sakai et al. | 57/5 |
| 4,928,464 | 5/1990 | Morrison | 57/224 |
| 4,986,066 | 1/1991 | Morrison | 57/333 |

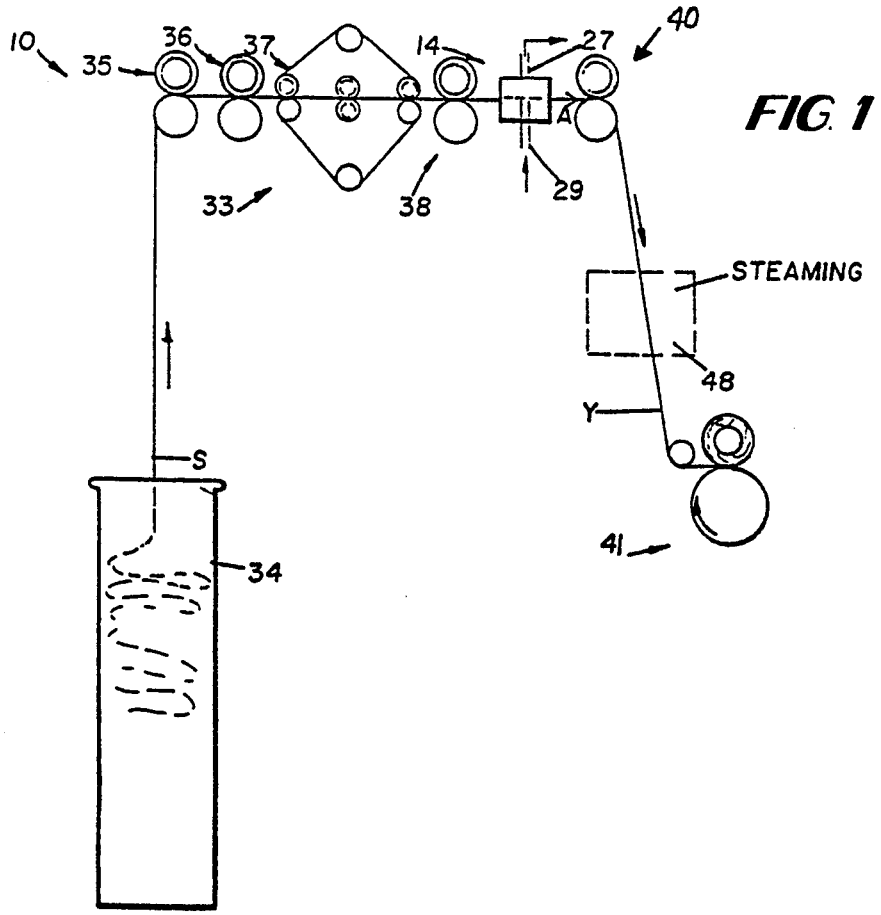
FIG. 1
FIG. 2
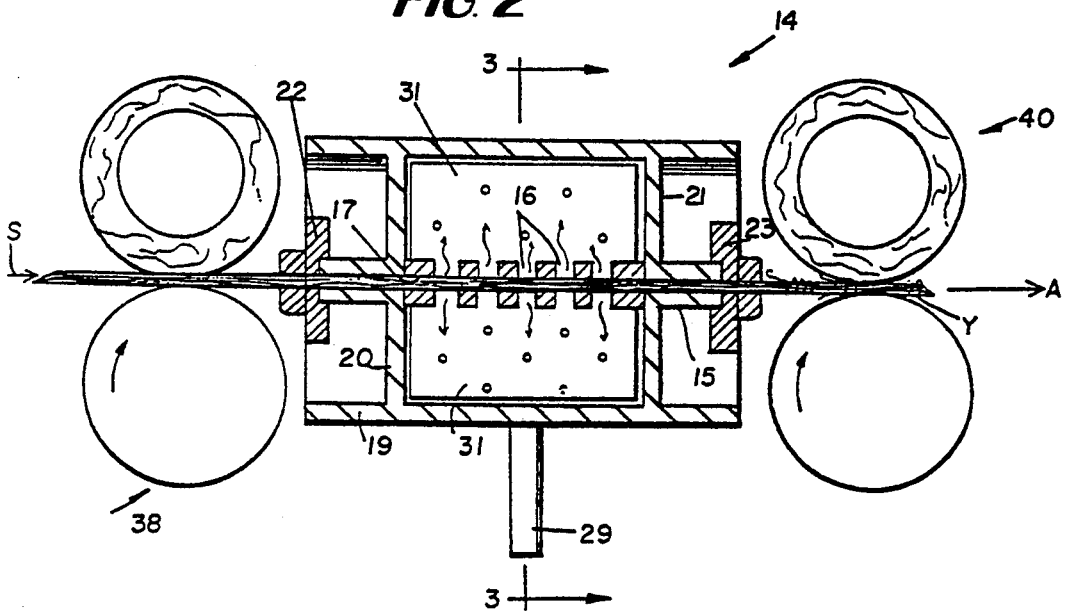

65
64
Y'
VACUUM SOURCE
28
A
38
12
14
27
29
19
57
62
59
50
53
51
52
60
58
S
34

SPINNING WITH HOLLOW ROTATABLE SHAFT AND AIR FLOW

CROSS REFERENCE TO RELATED APPLICATIONS

This application is a continuation of application Ser. No. 07/263,187, filed Oct. 27, 1988, now abandoned, which in turn is a continuation of application Ser. No. 07/041,835, filed Apr. 21, 1987, now U.S. Pat. No. 4,928,464, issued May 29, 1990; which in turn is a continuation of application Ser. No. 06/680,510, filed Dec. 11, 1984, now U.S. Pat. No. 4,719,744, issued Jan. 19, 1988; which in turn is a continuation-in-part of application Ser. No. 06/386,078, filed Jun. 7, 1982, now U.S. Pat. No. 4,507,913, issued Apr. 2, 1985.

BACKGROUND AND SUMMARY OF THE INVENTION

Conventional spun yarns are normally made by ring spinning or open-end spinning. While such methods produce good quality yarn, there are certain restrictions and complications associated therewith. For instance open-end spinning systems have rather restrictive limitations as to staple length, rotor speeds, twist directions, wrapper fibers, fibers per cross-sectional area, and fiber bending modulus, stiffness, and other properties. According to the present invention, an appratus and method are provided which seek to eliminate a number of the restrictions associated with open-end spinning, and in general to provide for the production of spun yarn in a simple, uncomplicated manner. The yarns produced according to the present invention have somewhat different appearance and construction characteristics than conventional spun yarns, but definitely have a spun appearance.

The basic apparatus for practicing the methods of the present invention comprises a hollow shaft with at least a portion of the entire circumference thereof being perforated, and mounted for rotation about an axis coincident with the direction of movement of fibers being spun into yarn. The fibers are fed into a first end of the hollow shaft, and the produced yarn is withdrawn from the second end of the hollow shaft. The shaft is caused to rotate at high speed, and a vacuum is applied to the exterior of the shaft to supply an attractive force to the free ends of the fibers interior of the shaft. A vacuum sucks ambient air through a housing interior to act upon the interior of the shaft, imparting rotation to fibers within the shaft.

Spun-type yarn produced according to the present invention may be produced from a wide variety of types of fibers, such as cotton, polyester, rayon, acrylic, wool, mohair, etc., the spinning process not being as dependent upon bending modulus or stiffness of the composite fibers as is conventional open-end spinning. According to the invention, open-end type spun yarn can be formed with fewer fibers per cross-sectional area, and the yarn will have real twist, either "Z" or "S" direction twist. Restrictions on the end use of open-end type spun yarn according to the invention would not be comparable to conventional open-end spun yarns, but rather would be more comparable to conventional ring spun yarns.

According to one aspect of the method according to the present invention, a spun yarn is produced by the following steps: (a) nipping a sliver or roving so that some of the fibers within the fibers or roving have loose ends; (b) transporting the nipped sliver or roving in a linear direction A at a substantially constant linear speed; (c) feeding a core filament into the sliver or roving, after nipping, so that the core filament passes with the nipped sliver or roving in the direction A; and (d) while transporting the sliver or roving, and core filament, in direction A, rotating loose ends of fibers around the fiber mass, and the core filament, the ends being held substantially linearly stationary during rotation, to produce the desired yarn, with core filament. The core filament yarn preferably comprises a full stretched textured yarn, and preferably it is acted upon by putting it under tension, dragging it over a sharp edge of nonconductive material, and releasing the tension to develop crimp.

According to another aspect of the present invention, a method is provided having the same steps (a) and (b) as set forth above, and including the following additional steps: (c) inserting a filament having controlled overfeed into association with the nipped sliver or roving while moving in direction A, at a predetermined point; and (d) immediately after the predetermined point, rotating loose ends of fibers of the nipped sliver or roving, while the ends are held substantially linearly stationary during rotation, to wrap the fiber ends around other fibers and the filament to produce a spun yarn having loop or Boucle effects.

According to yet another aspect of the present invention, a method is provided having the same steps (a) and (b) as the embodiments described above, and comprising the further steps of: (c) feeding a filament yarn into operative association with the nipped sliver and roving as it moves in the linear direction A, while applying a force substantially in direction A effective to break up to about 20% of the fibers of the filament yarn; and (d) while transporting the sliver or roving in direction A, with free ends and with broken fibers, rotating loose ends of fibers and acting upon broken fibers so that the fiber ends are wrapped around the nipped sliver or roving, and the broken fibers interact with the nipped sliver or roving, to produce a yarn having a spun-like appearance.

According to a still further aspect of the present invention, a method of spinning yarn is provided comprising the following steps: (a) Acting upon a sliver or roving to produce fibers, and so that essentially all of the fibers are fibers having short staple lengths and free ends. (b) Transporting the fibers in a linear direction A at a substantially constant linear speed. And, (c) while transporting the fibers, rotating the loose ends to provide a core formed of approximately 20–40% of the fibers, the core having real twist; and approximately 80–60% of the fibers wrapped about the core to provide surface effects, and simulating the appearance of a fully twisted yarn. A yarn produced according to this procedure does realistically simulate the appearance of a fully twisted yarn.

It is the primary object of the present invention to provide for the simple, effective production of spun yarn. This and other objects of the invention will become clear from an inspection of the detailed description of the invention, and from the appended claims.

BRIEF DESCRIPTION OF THE DRAWINGS

FIG. 1 is a side schematic view of an exemplary system for producing vacuum-spun yarn according to the present invention;

FIG. 2 is a side detail cross-sectional view of an exemplary vacuum spinning device for the practice of the invention, the cross-section being taken along lines 2—2 of FIG. 3;

DETAILED DESCRIPTION OF THE DRAWINGS

Figure 6:
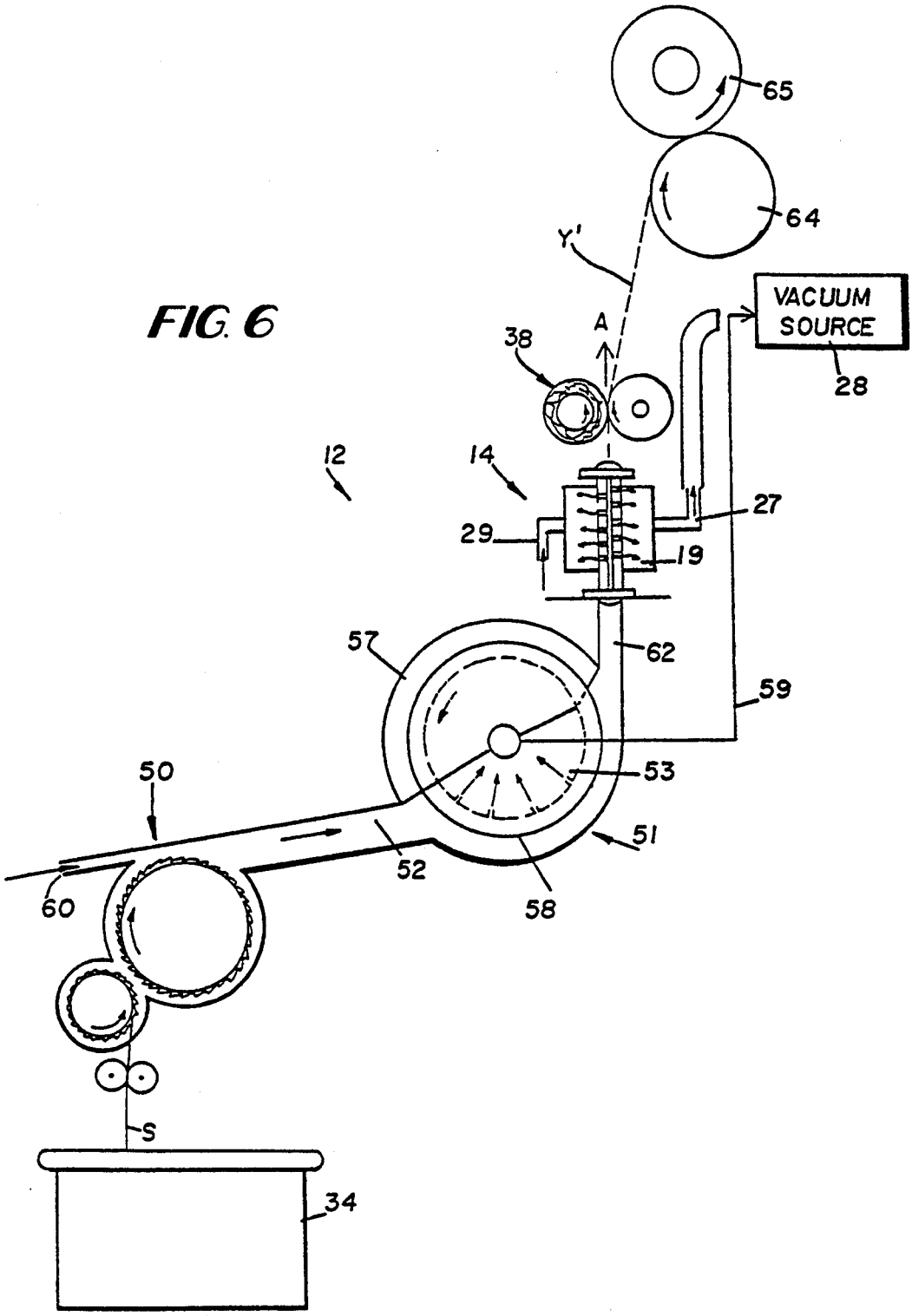
FIG. 6 is a side schematic showing of exemplary apparatus for producing an open-end type vacuum spun yarn according to the invention, while FIG. 5*b* schematically illustrates a construction of a yarn produced utilizing the apparatus of FIG. 6.

Two different embodiments of apparatus for producing vacuum spun yarn according to the present invention are illustrated in FIGS. 1 and 6, by general reference numerals 10 and 12, respectively. The apparatus 10 produces a yarn similar to conventional ring-spun yarn, while the apparatus 12 produces an open-end type spun yarn, which yarn—however—has properties similar to both conventional ring-spun and open-end spun yarns. A major component of each of the systems 10, 12 is the vacuum spinning apparatus 14, which is shown most clearly in FIGS. 2 and 3.

The apparatus 14 comprises as the main component thereof a hollow shaft 15. At least a portion of the entire circumference of the hollow shaft 15 is perforated. Preferably the central portion of the shaft has perforations 16 formed therein. The shaft is mounted for rotation about an axis, that axis being coincident with the linear direction of feed A of fibers to be produced into yarn. The shaft should be dimensioned so that it allows the fibers to pass therethrough, and allows enough air to be drawn through with the fibers to allow proper vacuum-attraction of fibers to the interior surface 17 thereof.

The shaft 15 perforated central portion is encompassed by a housing 19. Rotation of the shaft about its axis may be provided by bearings associated with housing end walls 20, 21, and/or further bearings 22, 23 receiving the ends of shaft 15 extending outwardly from the end walls 20, 21. The shaft 15 is mounted for free rotation.

A vacuum is applied to the housing 19 interior, to an exterior portion of the shaft 15, so as to act upon yarn fibers within the hollow interior of the shaft 15. This is preferably accomplished by providing a vacuum conduit 27 in operative communication with one portion of the housing 19 interior, and is connected up to a conventional vacuum source 28, such as a vacuum pump. Connected to the interior of the housing opposite the conduit 27 (i.e. on the opposite side of shaft 15) is a conduit 29 which is in operative communication with the ambient air, or other source of supply of gas.

Connected to the shaft (preferably integral therewith) are a plurality of radially extending vanes 31. These vanes 31 extend to a radial point just short of the interior surface of the housing 19. When a vacuum is applied to conduit 27, air is drawn through conduit 29, acts upon the vanes 31 effecting rotation of the shaft 15, and is withdrawn through conduit 27. While this is taking place, air is also being withdrawn from the interior of shaft 15, and fibers are being attracted to the interior surface 17 of shaft 15. For the arrangement illustrated in FIG. 3, rotation is in the direction of arrows B, however the structure could be arranged so that rotation were in the opposite direction.

The apparatus 14 provides a simple, effective structure for producing spun yarn. It is simple and easy to maintain, may be easily rotated at high speed, and may be formed of lightweight, durable materials.

Associated with the vacuum spinning device 14 and the apparatus 10 is a draft system, generally indicated by reference numeral 33 in FIG. 1. A sliver or roving S from a bin 34 is drawn by feed roll sets 35, 36, 37, and passed through the nip of front feed roll set 38. The nip of the front feed roll set 38 is in-line with the axis of rotation of shaft 15. The draft system 33 acts upon the fibers of the sliver or roving S so that approximately 75–90% of the fibers within the mass are nipped and held tight. The remaining approximately 25–10% of the fibers have loose ends.

A set of delivery rolls 40 is mounted on the opposite side of apparatus 14 as the draft system 33, the nip of the roller set 40 also being in alignment with the axis of rotation of shaft 15. The delivery roll set 40 draws the formed yarn Y out from the apparatus 14, and eventually the yarn Y is taken up on conventional take-up roller means 41.

When the fibers are passed into the hollow interior of the shaft 15, free ends of the fibers are attracted to the interior surface 17 by the vacuum while the basic fiber mass is being transported in the linear direction A. Fiber ends attracted to the interior surface 17 are held substantially linearly stationary while they rotate with the shaft 15, and thus such fibers become wrapped around the main fiber mass. The shaft 15 is rotated at about 1.5–6.0 rpm/inch of fibers drawn through the shaft in order to provide sufficient wrapping to provide the desired strength to the yarn Y produced.

Figure 3:
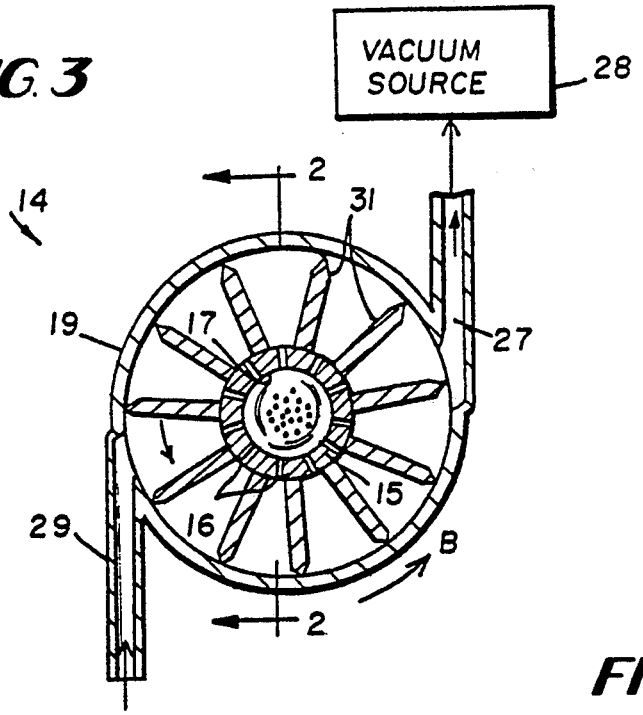
FIG. 3 is another cross-sectional view of the apparatus of FIG. 2, taken along lines 3—3 thereof.
Figure 5B:
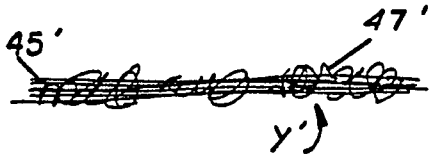
Figure 4:
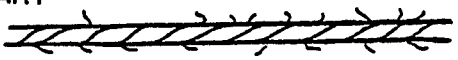
FIG. 4 PRIOR ART
FIG. 4 schematically illustrates a conventional ring-spun yarn construction, while FIG. 5*a* schematically illustrates a construction of a yarn produced utilizing the apparatus of FIG. 1.
Figure 5A:
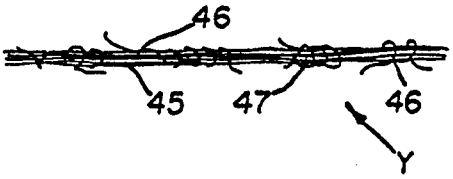

Yarn Y produced according to the invention of FIGS. 1 through 3 is illustrated schematically in FIG. 5*a*. This yarn Y can be compared to conventional ring-spun yarn illustrated in FIG. 4, the yarn of FIG. 4 having a beardy look with actual full diameter twists around the yarn. Yarn Y according to the invention, however, includes a central mass 45 with some fibers 46 wrapped therearound in a linear direction, while other fibers 47 have a reverse fold wrap.

If necessary, the yarn Y may be steamed in order to better secure and set the wrapped fibers 46, 47. This may be accomplished by passing it through a conventional steaming apparatus 48 prior to being taken up by rollers 41, or steaming may be practiced as an entirely different step after take up.

Fabric produced from yarn Y (55% polyester fibers and 45% wool fibers) has been found to have very uniform dyeability.

Figure 7:
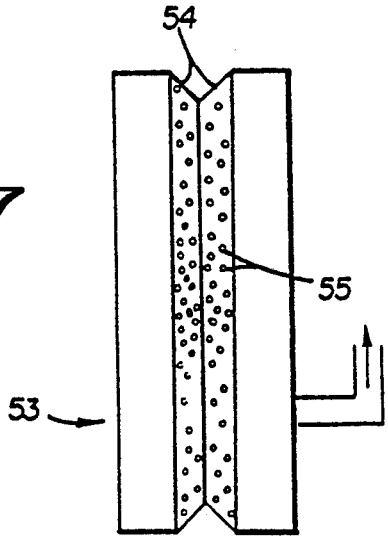
FIG. 7 is an end view of the collector roll of the apparatus of FIG. 6.

The apparatus 12 of FIG. 6 includes, in place of the draft system 33 of apparatus 10, a conventional combing roll assembly 50, and a collector roll assembly 51. The combing roll assembly 50 forms individual fibers from the sliver or roving S, and passes them through air throat 52 to the collector roll assembly 51. The collector roll 53 of the collector roll assembly 51 is illustrated more clearly in FIG. 7, and includes means defining a groove 54 therein. Also, means are provided defining a plurality of perforations 55 in the groove 54. The collector roll assembly 51 includes a housing portion 57 in which no vacuum is applied, and another portion 58 in which vacuum is applied from source 28 so that air is pulled from the exterior of the roller 53 through perforations 55 to the interior of the roller 53, ultimately being passed through conduit 59 to vacuum source 28.

The fibers in throat 52 are entrained in a balanced air flow, air entering air intake 60, and also being pulled through combing roller 53 perforations 55 by the vacuum source 28, so that the fibers in air throat 52 are generally parallel. Typical staple length would be ½–6 inches. The fibers collect on roll 53 side-by-side, and build up in fiber layers depending upon the speed of roll 53. Approximately ⅜ of the roll 53 is subjected to the vacuum source 28, while the other ⅝ is not. The fibers are released by the roll 53 on the upside of roller assembly 51 into air throat 62, under the influence of the vacuum applied to the interior of the housing 19 of the vacuum spinning device 14.

When the mass of free fibers pass through air throat 62 into the hollow interior of shaft 15, they are attracted to the interior surface 17 of shaft 15, and rotate therewith as they are being conveyed in the direction A. This rotation fully controls the fibers, so they do not have the same type of entanglement that is present in conventional open-end spinning processes. The yarn Y′ is produced. The fiber mass or core 45′ (see FIG. 5*b*) has real twist, which may be in either the "Z" direction or the "S" direction, and the fiber mass or core typically includes 20–40% of the fibers while 80–60% of the fibers are in wrapping 47′. The yarn Y′ has significant surface effects and simulates the appearance of fully twisted yarn.

The yarn Y′ withdrawn from apparatus 14 by delivery rolls 38 is taken up by a conventional dog or grooved type take-up roll 64, onto a package 65. The yarn Y′ may be formed from a wide variety of fibers, bending modulus, stiffness, and other properties of the fiber type not being as critical as in conventional open-end spinning; and the yarn Y′ may be spun with fewer fibers per cross-sectional area.

Yarn Y′ also may be produced by running short staple length fibers (e.g. 1½inch cotton/polyester fibers) on a 4 inch worsted roll setting between the rolls 38, 40. Again, the core 45′ (see FIG. 5*b*) will have approximately 20–40% of the fibers and the core will have real twist, and approximately 80–60% of the fibers will be wrapped about the core to provide surface effects and simulate the appearance of a fully twisted yarn. For example, for the yarn Y′ illustrated in FIG. 5*b*, the turns per inch in the sheath wrapped fibers 47′ could be 10 "Z", while the turns per inch in the core yarn 45′ could be 10 "Z". Note, however, that the number of fibers that are transformed into the core versus the number of wrapper fibers are variable and depend upon: staple length versus roll setting between rolls 38 and 40; vacuum pressure and nozzle configuration; nozzle rotation speed and orifice size; spinning speed of the yarn; and fiber characteristics such as stiffness, friction properties, diameter, etc.

Figure 8:
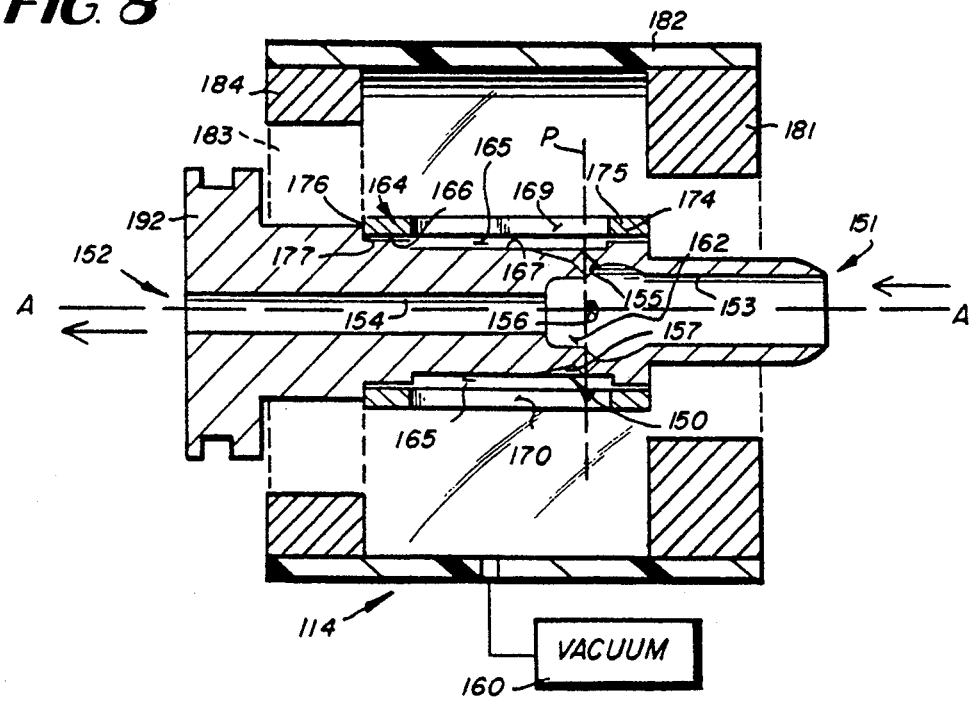
FIG. 8 is a side cross-sectional view of another, preferred, embodiment of a vacuum spinning apparatus utilizable in the practice of the method of the present invention.

The preferred vacuum spinning apparatus 114 is disclosed more fully in copending application Ser. No. 06/677,487, filed Dec. 3, 1984, and is illustrated in FIG. 8. The primary component thereof comprises an elongated hollow shaft 150 having a first end 151 and a second end 152. A through-extending passageway, having a first section 153 and a second section 154, is provided in the shaft 150, extending from the first end 151 to the second end 152 thereof. At least a portion of the entire circumference of the shaft 150 is perforated. Preferably the perforations are provided by four perforations equally spaced around the circumference of the exterior of the shaft 150, and indicated by reference numerals 155–157 in FIG. 8. Perforations preferably are in a common plane P which is perpendicular to the axis A—A of rotation of the shaft 150. Also, the perforations 155–157 preferably slant in the direction of the second end from the through-extending passageway portion 153 (see perforations 155, 157 in FIG. 8 in particular). This disposition of the perforations 155–157 at an acute angle with respect to the axis A—A allows air that is sucked into the passageway portion 153 by the vacuum source 160 to flow more uniformly from exteriorly of the shaft 150 to the source 160, with commensurate desirable results for the yarn being produced.

While perforations 155–157 may be disposed at other locations along the length of the shaft 150, and need not be four in number (i.e. there may be more, but preferably not less than three), the desired results can be achieved by disposing the perforations 155–157 adjacent the first end 151 of the shaft 150.

A vacuum reservoir 162 is provided within the shaft 150. The vacuum reservoir 162 as illustrated in the drawing comprises a spherical reservoir having a diameter roughly about twice the diameter of the passageway portion 153, and in communication with the passageway portions 153, 154 at the opposite ends thereof, and in communication with the perforations 155–157 around the periphery thereof. The reservoir need not be spherical, although that is a desirable configuration. Alternatively, the reservoir could be cylindrical with spherical sections at the ends thereof, or of like configuration. The vacuum reservoir provides for better air flow within the shaft 150, ultimately resulting in better wrapping of the fiber ends, and the production of a higher quality yarn.

In the utilization of the apparatus 114, it is desirable to concentrate the air flow adjacent the first end 151 of the shaft 150. To this end, it is desirable to make the passageway section 153 of significantly larger size than the passageway 154. The passageway 153 extends from the end 151 to the vacuum reservoir 162, while the section 154 extends from the vacuum reservoir 162 to the second end 152. As exemplary, but non-limiting, examples of dimensions, the diameter of the section 153 may be ⅛ inch, the diameter of the section 154 1/16 inch, and the diameter of the spherical vacuum reservoir 162 about one-quarter inch.

In order to even further facilitate the wrapping action, it is desirable to provide a diffuser 164. The diffuser 164 comprises a sleeve or collar which fits around the external periphery of the shaft 150. Preferably a ring-shaped space 165 is provided between the internal surface 166 of the collar 164, and the external periphery 167 of the shaft 150. The collar 164 includes a plurality of elongated slots formed therein, elongated in the dimension of the axis A—A. Preferably a slot is provided in association and communication with each of the perforations 155–157; for instance see slots 169 and 170 in FIG. 8 which cooperate with perforations 155 and 157, respectively. The slots (e.g. 169, 170) and the space 165 assist in providing desired air flow characteristics to improve the quality of the yarn produced utilizing the apparatus 114.

The collar 164 is preferably mounted on the shaft 150 so that the alignment of the slots (e.g. 169–170) with respect to the perforations 155–157 can be changed. For instance the collar 164 is mounted so that a first end surface 174 engages surfaces 175 of the shaft 150, and so that the second end surface 176 thereof engages another raised surface 177 of the shaft 150. There is frictional engagement between the surfaces 174, 175 and 176, 177, however the frictional engagement is not too great to prevent relative rotation between the collar 164 and the shaft 150 as the collar 164 is grasped manually, or with a tool, and the rotation effected. By misaligning the slots (e.g. 169–170) and the perforations 155–157, "effects" may be introduced into the yarn Y.

Roller sets 38, 40, comprise means for passing textile fibers into and through the passage sections 153, 154, and preferably the nips of the rollers 38, 40 are aligned with each other and with the axis A—A. Means are also provided for mounting the shaft 150 for rotation about the axis A—A, and for effecting continuous, relatively high-speed rotation thereof.

The means for mounting the shaft 50 for rotation preferably comprise bearing means adjacent the first and second ends 151, 152 thereof. For instance a first bearing means 180 surrounds the first end 151 of the shaft 150, providing relative rotation between it and a front wall 181 of an air impervious cylindrical housing 182, and a second bearing 183 is mounted adjacent the second end 152 of the shaft 150, allowing relative rotation between the shaft 150 and the rear wall 184 of the housing 182. Preferably the housing 182 is transparent. The bearings 180, 183 may be of any conventional type that will not allow much air flow through them, and are not dried out, or otherwise damaged, by air flow. The housing 182 is stationarily mounted on a table, or other structure which is affixed to the ground.

Rotation of the shaft 150 is effected by a motor acting upon the shaft via pulleys and a belt. Pulley 192 preferably is integral with the shaft 150, and another pulley is integral with the motor output shaft. The motor thus rotates the shaft 150 at a constant desired speed, which speed may be varied by varying the speed of the motor.

Figure 9:
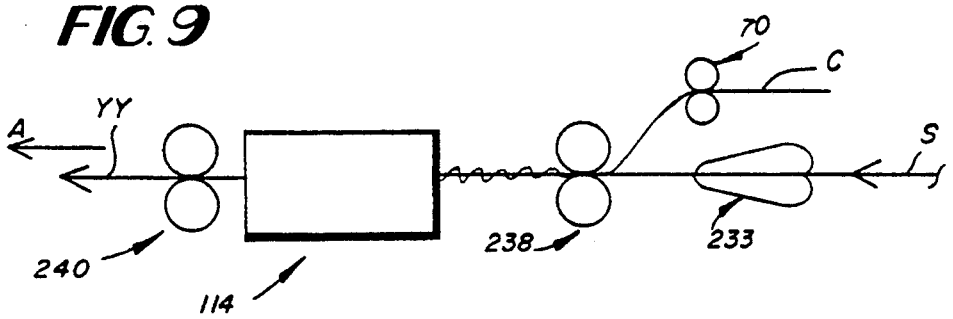
FIG. 9 is a schematic view illustrating the apparatus utilizable in the feeding of a core filament yarn so as to produce another variation of yarn in the practice of the present invention.

FIG. 9 schematically illustrates an apparatus useful for core spinning. Structures in this embodiment comparable to structures in the FIG. 1 embodiment are illustrated by the same reference numeral only preceded by a "2". The vacuum spinning apparatus is preferably the apparatus 114 illustrated in FIG. 8. In this embodiment, a core filament C is fed by a set of rolls 70 to feed rolls 238 to travel with the sliver or roving S generally in the linear direction A. If desired, a force may be applied to the filament yarn C generally in direction A so as to cause up to about 20% of the fibers of the core C to be broken. This may be accomplished by putting a predetermined draft between the rolls 240, 238. The broken fibers react inside vacuum spinning apparatus 114 as spun fibers, lending a spun-like appearance to the yarn YY being produced.

Figure 10:
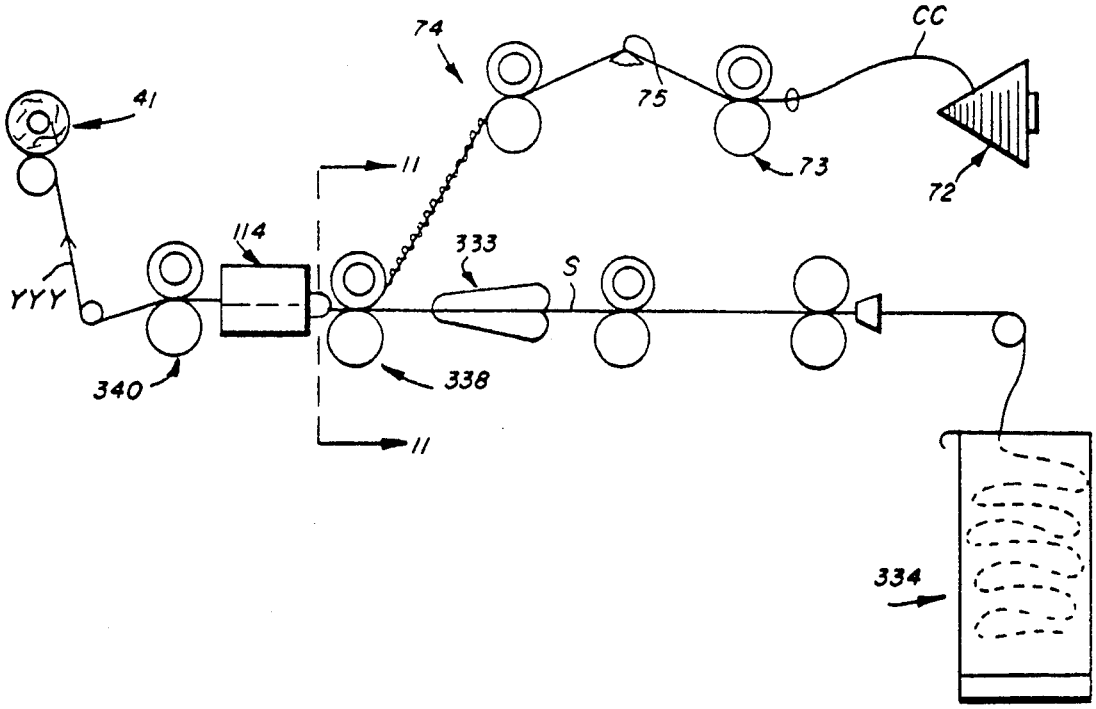
FIG. 10 is a side schematic view of another exemplary apparatus for developing crimp in an inserted core filament yarn before feed of the yarn to the vacuum spinning assembly.
Figure 11:
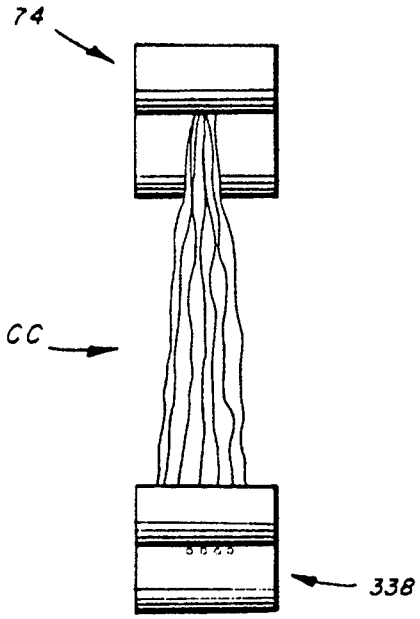
FIG. 11 is a front schematic view taken generally along lines 11—11 of FIG. 10.

Illustrated in FIGS. 10 and 11 is other exemplary apparatus for producing a core spun yarn, and in this embodiment crimp is developed in the core filament yarn so as to provide good interaction between the core fibers and the nipped sliver roving fibers S.

With reference to FIGS. 10 and 11, a full stretch textured yarn CC is removed from a supply 72, and is held in tension between roller sets 73, 74. Between the roller sets 73, 74 it is passed over a sharp edge 75 of a nonconductive material (such as a plastic wedge). Crimp is developed in the filament yarn CC after it passes over edge 75 and the tension is released between rolls 74 and 338. (In the FIGS. 10 and 11 embodiments structures comparable to those in the FIG. 1 embodiment are illustrated by the same reference numeral only preceded by a "3".) This crimp developing step causes the individual fibers of the yarn CC to repel each other (see FIG. 11) to form a separated, wide mass of fibers, and when the separated fibers of the yarn CC are then combined with the nipped sliver fibers S, good interaction therebetween is provided, and when the fibers are subjected to the vacuum spinning in vacuum spinner 114, a unique yarn YYY is produced. Such yarn YYY can have the best properties of 100% staple fibers and textured yarn, with predominantly spun fibers on the outside of the yarn formation. Exemplary yarns that may be produced are as follows:

| Count | Component Description | % Content |
|---|---|---|
| 1/20's | sliver 35 Grs./Yd. 55% Poly/45% Wool | 62% |
| | core 150/34 T-242T F.S. Polyester | (34% Poly/ 28% Wool) 38% |
| 1/27's | sliver 35 Grs./Yd. 100% Wool | 76% |
| | core 70/34 T-242T F.S. Polyester | 24% |
| 1/20's | sliver 35 Grs./Yd. 100% Wool | 62% |
| | core 150/34 T-242T F.S. Polyester | 38% |
| 1/30's | sliver 35 Grs./Yd. 100% Wool | 44% |
| | core 150/34 T-242T F.S. Polyester | 56% |

Figure 12:
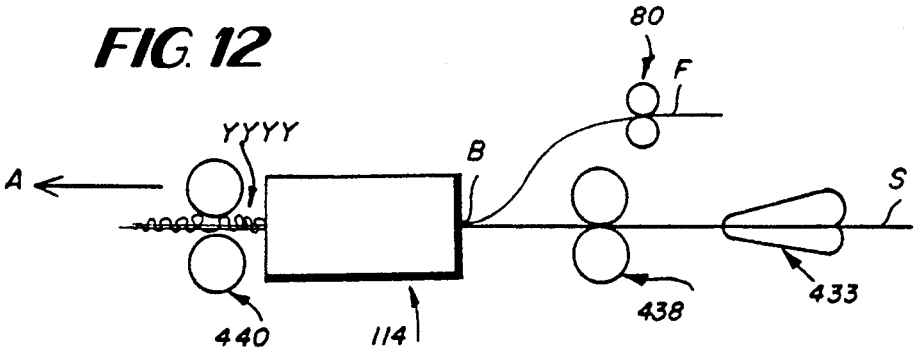
FIG. 12 is a side schematic view of yet another form of exemplary apparatus for practicing another method according to the present invention.

FIG.12 illustrates exemplary apparatus for practicing yet another method according to the invention. In this embodiment, structures comparable to those in the FIG. 1 embodiment are illustrated by the same reference numeral only preceded by a "4". In this embodiment, a continuous filament yarn F is passed directly to a point B at the entrance to the vacuum spinning assembly 114 hollow shaft (i.e. shaft end 51 in FIG. 8). Controlled overfeed of the yarn F is provided by the roller set 80, the overfeed being controlled to achieve a desired loop or Boucle effect in the yarn YYYY ultimately produced.

It will thus be seen that according to the present invention various methods of producing yarn, and various yarns produced thereby, are provided which allow the production of a wide variety of yarns, many having unique characteristics, effects, properties, or appearance. The filament yarns introduced (e.g. C, CC, F) may be multi-color yarns (such as Solution Dyed Rayon), to provide a unique multi-color effect for styling purposes.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and products.

What is claimed is:

1. A method of spinning yarn utilizing a rotatable hollow shaft having an entrance at one end thereof, and an exit at the other, and rotatable about an axis extending in a direction A, comprising the steps of:

(a) feeding a plurality of free fibers in a linear direction A, in a fiber mass, certain of the fibers having free ends;

(b) passing the fiber mass into the interior of the hollow rotatable shaft through the entrance thereof;

(c) establishing an air flow about the fiber mass to effect separation of the free ends of the fibers which air flow is initially substantially unidirectionally in direction A, and then is deflected to move at an angle with respect to the direction A away from the shaft;

(d) rotating the shaft at high speed about the axis so that the free ends of the fibers are drawn within the shaft and wrap around other portions of the fiber mass while such other portions remain substantially untwisted to produce a yarn; and (e) withdrawing the yarn through the exit of the shaft.

2. A method as recited in claim 1 wherein step (c) is practiced by providing a vacuum which acts on the free fibers.

3. A method as recited in claim 2 wherein step (c) is practiced by solely applying a vacuum.

4. A method as recited in claim 1 wherein the air flow includes a component in the direction of rotation of the shaft.

5. A method as recited in claim 1 wherein the fibers are staple fibers.

6. A method as recited in claim 5 wherein the fibers have a staple length of about one inch to about 6 inches.

7. A method of spinning yarn utilizing a rotatable hollow shaft having an interior and an entrance at one end thereof, and an exit at the other end, and rotatable about an axis extending in a direction A, comprising the steps of:

(a) feeding a plurality of substantially untwisted free fibers in a linear direction A, in a fiber mass thereof, certain of the fibers having free ends;

(b) passing the substantially untwisted fiber mass into the interior of the hollow rotatable shaft through the entrance thereof;

(c) establishing an air flow about the untwisted fiber mass to effect separation of the free ends of the substantially untwisted free fibers;

(d) rotating the shaft at high speed about the axis so that the separated free ends of the fibers wrap around other portions of the substantially untwisted fiber mass within the shaft while maintaining such other portions substantially untwisted to produce a yarn having a substantially untwisted core and fiber ends wrapped about the core; and (e) withdrawing the yarn through the exit of the shaft.

8. A method as recited in claim 7 wherein step (c) is practiced by providing a vacuum which acts on the free fibers.

9. A method as recited in claim 8 wherein step (c) is practiced solely by applying a vacuum.

10. A method as recited in claim 7 wherein the air flow includes a component in the direction of rotation of the shaft.

11. A method as recited in claim 7 wherein the fibers are staple fibers.

12. A method as recited in claim 11 wherein the fibers have a staple length of about one inch to about six inches.

* * * * *